United States Patent [19]

Gorin

[11] 4,247,385

[45] Jan. 27, 1981

[54] METHOD FOR HYDROCRACKING A HEAVY POLYNUCLEAR HYDROCARBONACEOUS FEEDSTOCK IN THE PRESENCE OF A MOLTEN METAL HALIDE CATALYST

[75] Inventor: Everett Gorin, San Rafael, Calif.

[73] Assignee: Conoco, Inc., Stamford, Conn.

[21] Appl. No.: 78,639

[22] Filed: Sep. 26, 1979

[51] Int. Cl.[3] ..... C10G 1/00; C10G 1/06; C10G 65/00

[52] U.S. Cl. ..... 208/10; 208/8 LE; 208/59

[58] Field of Search ..... 208/8 LE, 10, 59

[56] References Cited

U.S. PATENT DOCUMENTS

| | | | |
|---|---|---|---|
| 3,677,932 | 7/1972 | Hardesty et al. | 208/10 X |
| 3,679,577 | 7/1972 | Wantland et al. | 208/10 X |
| 3,736,250 | 5/1973 | Berg et al. | 208/10 |
| 3,790,468 | 2/1974 | Loth | 208/10 |
| 4,132,628 | 1/1979 | Pell | 208/10 X |

*Primary Examiner*—Delbert E. Gantz
*Assistant Examiner*—William G. Wright
*Attorney, Agent, or Firm*—F. Lindsey Scott; William A. Mikesell, Jr.

[57] ABSTRACT

A method for hydrocracking a heavy polynuclear hydrocarbonaceous feedstock to produce lighter hydrocarbon fuels by contacting the feedstock with hydrogen in the presence of a molten metal halide catalyst, the method comprising: mixing the feedstock with a heavy naphtha fraction which has an initial boiling point from about 100° to about 160° C. with a boiling point difference between the initial boiling point and the final boiling point of no more than about 50° C. to produce a mixture; thereafter contacting the mixture with partially spent molten metal halide and hydrogen under temperature and pressure conditions so that the temperature is near the critical temperature of the heavy naphtha fraction; separating at least a portion of the heavy naphtha fraction and lighter hydrocarbon fuels from the partially spent molten metal halide, unreacted feedstock and reaction products; thereafter contacting the partially spent molten metal halide, unreacted feedstock and reaction products with hydrogen and fresh molten metal halide in a hydrocracking zone to produce additional lighter hydrocarbon fuels and separating at least a major portion of the lighter hydrocarbon fuels from the spent molten metal halide.

9 Claims, 1 Drawing Figure

Figure 1:
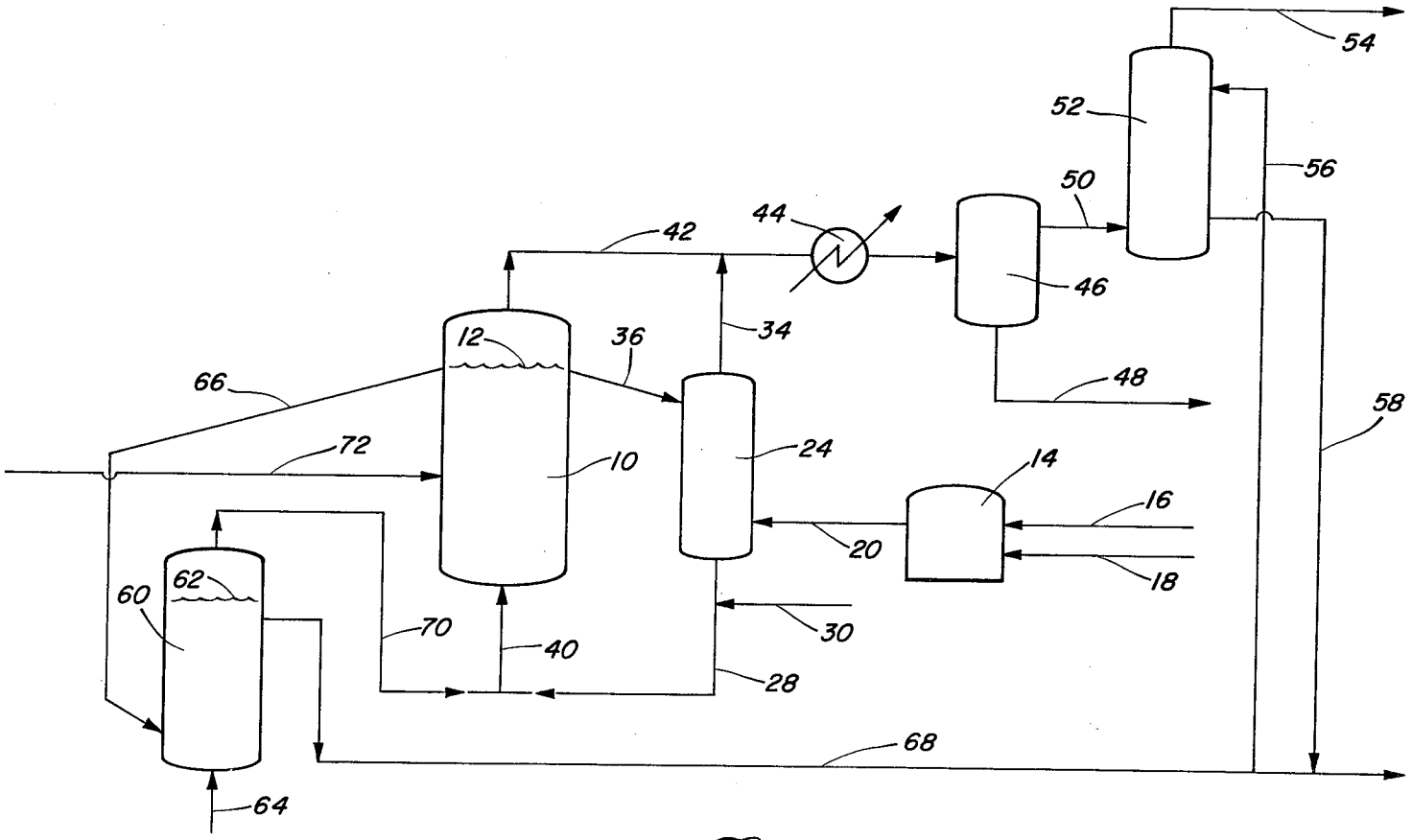

METHOD FOR HYDROCRACKING A HEAVY POLYNUCLEAR HYDROCARBONACEOUS FEEDSTOCK IN THE PRESENCE OF A MOLTEN METAL HALIDE CATALYST

This invention resulted from work done pursuant to a contract with the Department of Energy (DoE contract No. EX-76-C-01-1743).

This invention relates to a method for hydrocracking a heavy polynuclear hydrocarbonaceous feedstock by contacting the feedstock with hydrogen in the presence of a molten metal halide to produce lighter hydrocarbon fuels.

As a result of the continuing well known shortage of petroleum products such as gasoline, diesel fuel, natural gas and the like a continuing effort has been directed to the development of alternative fuel sources which do not depend upon petroleum as a feedstock. In particular, a considerable amount of effort has been devoted in recent years to the development of processes which will produce liquid and gaseous hydrocarbon fuels from coal feedstocks. One such process is the reaction of heavy aromatic polynuclear carbonaceous materials such as coal, coal extract and the like with hydrogen in the presence of a molten metal halide to produce gasoline range materials and other lower molecular weight hydrocarbon fuels. One such process is shown in U.S. Pat. No. 3,355,376 issued Nov. 28, 1967 to Gorin et al. Some similar processes are shown in:

| | | | |
|---|---|---|---|
| U.S. Pat. No. | 3,355,376 | 11-28-67 | Gorin et al. |
| | 3,371,049 | 2-27-68 | Gorin et al. |
| | 3,594,329 | 7-20-71 | Gorin et al. |
| | 3,625,861 | 12-7-71 | Gorin et al. |
| | 3,629,159 | 12-21-71 | Gorin et al. |
| | 3,708,270 | 1-2-73 | Birk et al. |
| | 3,728,252 | 4-17-73 | Pitchford |
| | 3,736,250 | 5-29-73 | Berg et al. |
| | 3,764,515 | 10-9-73 | Kiovsky |
| | 3,790,468 | 2-5-74 | Loth |
| | 3,790,469 | 2-5-74 | Loth et al. |
| | 3,844,928 | 10-29-74 | Geymer |
| | 3,998,607 | 12-21-76 | Wesselhoft et al. |
| | 4,081,400 | 3-28-78 | Gorin |
| | 4,120,668 | 10-17-78 | Fraley |
| | 4,132,628 | 1-2-79 | Peel |
| | 4,134,826 | 1-16-79 | Gorin |
| | 4,136,056 | 1-23-79 | Zielke |

These disclosures are hereby incorporated in their entirety by reference. Such processes have utilized various metal halides with zinc chloride being preferred. In such processes the lower molecular weight product hydrocarbons are normally recovered from the reaction zone either as a gaseous stream or in mixture with the spent molten metal halide. The mixture is subjected to flashing, distillation, solvent contacting or the like to recover the product hydrocarbons from the spent molten metal halide. The spent molten metal halide is normally regenerated and recycled to the processes by a variety of techniques many of which are shown in the references incorporated above.

In the practice of such processes the predominant product is gasoline range materials. In some instances it is desirable that a higher proportion of the products be recovered as fuel oils. Typically such fuel oils are considered to be those materials which have a boiling point greater than about 475° C. Such materials are readily used as boiler fuel or the like since the materials so produced are relatively low in nitrogen and sulfur. Further, the heavy fuel oils can be used to produce hydrogen by processes such as the Texaco partial oxidation process or the like. The process consumes hydrogen so the production of hydrogen using a heavy oil product is desirable.

It has now been found that additional quantities of fuel oil are produced by a method for hydrocracking a heavy polynuclear carbonaceous feedstock to produce lighter hydrocarbon fuels by contacting the heavy feedstock with hydrogen in the presence of a molten metal halide catalyst wherein the method consists essentially of (a) mixing the feedstock with a heavy naphtha fraction to produce a mixture the heavy naphtha fraction having an initial boiling point from about 100° to about 160° C. and a boiling point difference between its initial boiling point and its final boiling point of no more than about 50° C.; (b) contacting the mixture in an extractor zone with a partially spent molten metal halide and hydrogen under temperature and pressure conditions such that the temperature is within about 35° C. of the "pseudo" critical temperature, defined subsequently herein, of the heavy naphtha solvent; (c) separating a major portion of the heavy naphtha fraction and at least a portion of the fuel oil product contained in the partially spent molten metal halide from the partially spent molten metal halide, unreacted feedstock and reaction product; (d) contacting the molten metal halide, the unreacted feedstock and the reaction products with hydrogen and fresh molten metal halide in a hydrocracking zone to produce additional lighter hydrocarbon fuels and (e) separating at least a major portion of the lighter hydrocarbon fuels and at least a major portion of the unreacted hydrogen from the spent molten metal halide.

The drawing is a schematic diagram of a process embodying the method of the present invention. A hydrocracker 10 having a liquid level 12 is shown. The reactant materials in reactor 10 comprise molten metal halide, unreacted feedstocks, associated reaction products, hydrogen and the like. The feed stream to hydrocracker 10 is charged to a preparation area 14. Preparation area 14 is typically a coal slurry preparation area. The coal is finely divided and thereafter slurried with heavy naphtha. Coal is charged to preparation zone 14 via a line 16 with the heavy naphtha being charged through a line 18. It is to be understood that the feedstocks of the present process could consist of coal, coal extract, or other heavy hydrocarbonaceous materials. The mixture of heavy naphtha and feedstock is charged to a critical solvent extractor 24 via a line 20. Solvent extractor 24 contains partially spent molten metal halide, unreacted feedstock materials, reaction products, hydrogen and the like. A relatively small amount of hydrogen is charged to vessel 24 via a line 30 which is shown entering a line 28 which is a line for the withdrawal of liquid from extractor 24. It is contemplated that at least a portion the hydrogen so injected will rise through extractor 24 in an amount sufficient to maintain the liquid phase in extractor 24 substantially saturated with hydrogen with a portion of the hydrogen being entrained in the liquid withdrawn through line 28 and passed to hydrocracker 10. The conditions in critical solvent extractor 24 are maintained at a temperature and pressure such that the temperature in extractor 24 is near the "pseudo" critical temperature for the heavy naphtha. "Pseudo" critical temperature as used herein is defined by the following equation $$\text{pseudo critical temperature} = \Sigma \chi_\eta Y_\eta$$

where $\chi_\eta$ = the mole fraction of each component of the heavy naphtha fraction with the heavy naphtha fraction containing $\eta$ components.

$Y_\eta$ = the critical temperature of each the $\eta$ components in the heavy naphtha fraction Suitable conditions are a temperature from about 275° to about 385° C. (550°–725° F.) at a pressure from about 1500 to about 5000 psig. Residence times are the minimum required for the effective extraction of fuel oils and phase separation. The time is typically from about 2 to about 20 minutes. The temperature is adjusted to be near, i.e. typically within about 35° C. of, the pseudo critical temperature for the naphtha. As will be clear to those skilled in the art, the critical temperature as used herein is in fact a pseudo critical temperature as defined above since the critical temperature of a blend of materials such as is found in naphtha is difficult to determine. In any event the density of the extracting phase in extractor 24 is desirably regulated to a value from about 0.23 to about 0.35 grams/cc. The density is adjusted by regulation of the temperature. As will be obvious to those skilled in the art, a vaporous phase will be present in extractor 24 when the temperature is above the "pseudo" critical temperature of the naphtha, but when the temperature is below the "pseudo" critical temperature two liquid phases will be found in extractor 24. The vaporous or liquid stream withdrawn through a line 34 from vessel 24 contains at least a major portion of the heavy naphtha and a major portion of the heavy hydrocarbon fuel products contained in the partially spent molten metal halide injected through a line 36 and the feedstocks injected through line 20. Partially spent molten metal halide is withdrawn from hydrocracker 10 via line 36. The stream withdrawn from the lower portion of extracter 24 via line 28 is passed to a line 40 and thus into hydrocracker 10. Fresh molten metal halide is introduced into hydrocracker 10 via a line 72 and hydrogen is introduced into hydrocracker 10 via a line 70 and line 40. Spent molten metal halide is withdrawn from hydrocracker 10 via a line 66 and passed to a stripper 60, which is operated with a liquid level 62. Hydrogen is injected into stripper 60 via a line 64 and facilitates the removal of lighter hydrocarbon fuels from the spent molten metal halide contained in stripper 60. Stripper 60 typically operates at a temperature from about 425° to about 565° C. (800°–1050° F.) and a pressure from about 1500 to about 5000 psig. The hydrogen stream recovered from stripper 60 is passed through line 70 to provide the hydrogen feed to hydrocracker 10. Typically from about 85 to about 95 percent of the total hydrogen feed (fresh and recycle) to the process is passed through stripper 60. The remaining 5 to 15 percent of the hydrogen charged to the system is charged through line 30 with a portion of the hydrogen charged passing to extractor 24. The spent molten metal halide after contact with the hydrogen in vessel 60 is passed through a line 68 to regeneration. The lighter hydrocarbon fuels, unreacted hydrogen and the like produced in hydrocracker 10 are recovered via a line 42, combined with the heavy solvent and hydrocarbon fuels extracted in vessel 24 and recovered via a line 34 and passed through a condenser 44 to a separator 46. In separator 46, the heavier liquid hydrocarbon fuels are recovered via a line 48 and passed to further processing, recycle or the like with the lighter hydrocarbon fuels being recovered through a line 50 and passed to an HCl absorber 52. In HCl absorber 52 the vaporous materials are contacted countercurrently with spent molten metal halide which is charged to absorber 52 via a line 56 and recovered from absorber 52 via a line 58. The spent molten metal halide contains sufficient alkaline material to remove the vaporous HCl from the gaseous stream passed to absorber 52 via line 50. The vaporous stream, which may contain materials of a gasoline range and possibly even heavier, is passed to further processing and product recovery via a line 54.

In the practice of the present invention coal or other suitable feedstock is slurried with heavy naphtha which suitably has an initial boiling point from about 100° to about 160° C. and a boiling point difference between its initial boiling point and its final boiling point of no more than about 50° C. and passed to extractor 24. In extractor 24 as indicated, the temperature is within about 35° C. of the "pseudo" critical temperature for the heavy naphtha. Preferably the temperature in vessel 24 is slightly below the "pseudo" critical temperature. This results in an extracting phase in vessel 24 having a density from about 0.23 to about 0.35 grams/cc which is controlled by varying the temperature under suitable pressure conditions. In extractor 24 fuel oil range hydrocarbon fuels are extracted from the partially spent molten metal halide and to some extent from the feedstock by the heavy naphtha simultaneously with the transfer of the feedstock from the naphtha phase to the molten metal halide phase. At conditions near the critical temperature of the naphtha it tends to have a greater ability to remove soluble materials from the partially spent molten metal halide and the feedstock than at temperatures further removed from its critical temperature. As a result a substantial quantity of the heavier hydrocarbon fuels produced are extracted in vessel 24. Extractor 24 typically operates at a temperature from about 275° to about 385° C. (550°–750° F.) and a pressure from about 1500 to about 5000 psig with an average residence time for the feedstock of from about 2 to about 20 minutes. Preferably the extractor temperature is from about 310° to about 360° C. (600°–675° F.) at a pressure from about 2000 to about 3500 psig with a reaction time from about 3 to about 10 minutes.

The stream recovered from extractor 24 via line 28 contains partially spent molten metal halide, unreacted feedstock, various reaction products, in some instances unreacted hydrogen, and the like. This stream is passed to hydrocracker 10 which is typically operated at temperatures from about 400° to about 455° C. (750°–850° F.) and a pressure from about 1500 to about 5000 psig with an average residence time for the feedstock from about 10 to about 100 minutes. Preferably the reaction temperature is from about 405° to about 430° C. (775°–800° F.) at a reaction pressure from about 2000 to about 3500 psig with an average residence time from about 20 to about 40 minutes. The combined product streams from extractor 24 and hydrocracker 10 are passed to a separator 46 after condensation of the heavier hydrocarbon fuels. Typically separator 46 operates at a temperature from about 260° to about 370° C. (500°–700° F.) and a pressure from about 1500 to about 5000 psig with an average residence time from about 3 to about 15 minutes. Preferably the separator temperature is from about 290° to about 315° C. (550°–600° F.) at a pressure from about 2000 to about 3500 psig with an average residence time from about 5 to about 25 minutes.

The vaporous stream recovered from separator 46 via line 50 is passed to HCl absorber 52 which typically operates at a temperature from about 315° to about 385° C. (600°–750° F.) and a pressure from about 1500 to about 5000 psig with an average residence time from about 3 to about 15 minutes. Preferably the reaction temperature is from about 340° to about 370° C. (650°–700° F.) at a pressure from about 2000 to about 3500 psig with an average residence time from about 5 to about 25 minutes.

Many of the features of the present invention, such as the recovery and separation of the hydrocarbon fuels and the use of hydrogen to facilitate the separation of product hydrocarbon fuels from the spent molten metal halide prior to passing the spent molten metal halide to regeneration are known to those skilled in the art and form no part of the present invention. The essence of the present invention lies in the use of the particular sequence of process steps shown to utilize the near critical temperature properties of the heavy naphtha to achieve the production of increased quantities of fuel oil. Further since the heavy naphtha is used to slurry the feedstock rather than middle distillates such as gas turbine fuel, additional quantities of middle distillate fuels may be produced by the present method than is the case when the middle distillates are used to slurry the feedstock and ultimately hydrocracked to gasoline range materials etc. As a result the method shown does not produce as high a percentage of the feedstock materials as gasoline or gasoline range materials, but larger quantities of heavy fuel oil are produced. As indicated previously these fuel oils are relatively low in nitrogen and sulfur and are suitably used in boilers or the like or optionally used to generate hydrogen for use in hydrocracker 10. When the process is operated to produce in the neighborhood of 25 percent heavy fuel oil, the fuel oil can be used to produce hydrogen in an amount equal to roughly 110 percent of that required for the hydrogenation of the feedstocks charged to the process. The production of hydrogen in this way eliminates the need for complex processes for generating hydrogen from coal or coal residues. While such processes are known it is believed that the use of the heavy fuel oils to produce hydrogen will be somewhat less complicated.

As indicated previously the total hydrogen feed to the system is supplied through line 64 and line 30. From about 85 to about 95 percent of the total hydrogen feed, either fresh or recycle, is supplied through line 64 with the remaining 5 to 15 percent being charged through line 30. Typically the hydrogen is charged in an amount equal to from about 30 to about 120 standard cubic feet per pound of MAF coal. Preferably the range is from about 50 to about 80 SCF per pound of MAF coal. When the molten metal halide used is zinc chloride it is preferred that the molten metal halide be present in a amount equal to at least 15 weight percent based on the weight of feedstock. In many instances quantities of zinc chloride approximating 100 weight percent based on the feedstock will be used. Such variations and modifications are well known to those in the art as described in the patents incorporated hereinbefore by reference.

Having thus described the invention by reference to certain of its preferred embodiments it is respectfully pointed out that the embodiments described are illustrative rather than limiting in nature and that many variations and modifications are possible within the scope of the present invention.

Having thus described the invention I claim:

1. A method for hydrocracking a heavy polynuclear carbonaceous feedstock to produce lighter hydrocarbon fuels by contacting said heavy feedstock with hydrogen in the presence of a molten metal halide catalyst, said method consisting essentially of:

(a) mixing said feedstock with a heavy naphtha fraction to produce a mixture, said heavy naphtha fraction having an initial boiling point from about 100° to about 160° C. and a boiling point difference between its initial boiling point and its final boiling point of no more than about 50° C.;

(b) contacting said mixture in an extractor zone with a partially spent molten metal halide and hydrogen under temperature and pressure conditions so that said temperature is within 35° C. of the critical temperature of said heavy naphtha fraction for an effective period of time to extract at least a portion of the lighter hydrocarbon fuels having a boiling point above about 475° C. contained in said partially spent molten metal halide and in said feedstock;

(c) separating at least a portion of said heavy naphtha fraction and at least a portion of said lighter hydrocarbon fuels having a boiling point above about 475° C. from said partially spent molten metal halide, unreacted feedstock and reaction products;

(d) contacting said partially spent molten metal halide, said unreacted feedstock and said reaction products with hydrogen and fresh molten metal halide in a hydrocracking zone to produce additional lighter hydrocarbon fuels; and, (e) separating at least a major portion of said lighter hydrocarbon fuels and at least a major portion of the unreacted hydrogen from the spent molten metal halide.

2. The method of claim 1 wherein spent molten metal halide is withdrawn from said hydrocracking zone and passed to regeneration.

3. The method of claim 1 wherein said portion of said heavy naphtha fraction and said portion of said lighter hydrocarbonaceous fuels having a boiling point above about 475° C. are passed to further processing to separate at least a portion of said lighter hydrocarbonaceous fuels having a boiling point above about 475° C. from said heavy naphtha fraction.

4. The method of claim 1 wherein said feedstock is coal.

5. The method of claim 1 wherein said feedstock is coal extract.

6. The method of claim 1 wherein the vapor density in said extractor zone is from about 0.23 to about 0.35 gm/cc.

7. The method of claim 2 wherein said withdrawn spent molten metal halide is contacted with hydrogen to facilitate the removal of lighter hydrocarbonaceous fuels therefrom prior to passing said molten metal halide to regeneration.

8. The method of claim 6 wherein said temperature in said extractor zone is from about 275° to about 385° C. and wherein said pressure in said extractor zone is from about 1500 to about 5000 psig.

9. The method of claim 8 wherein the temperature in said hydrocracking zone is from about 400° to about 455° C. and wherein the pressure in said hydrocracking zone is from about 1500 to about 5000 psig.

* * * * *